United States Patent [19]

Unger

[11] Patent Number: 4,470,495

[45] Date of Patent: Sep. 11, 1984

[54] DEVICE FOR ENCOURAGING THE RETURN OF SHOPPING CARTS

[75] Inventor: John B. Unger, Centereach, N.Y.

[73] Assignee: Supermarket Sales and Maintenance Corp., Ltd., Hightstown, N.J.

[21] Appl. No.: 374,096

[22] Filed: May 3, 1982

[51] Int. Cl.[3] ..... G07F 7/06

[52] U.S. Cl. ..... 194/4 C

[58] Field of Search ..... 194/4 C, 4 E, 4 F, 4 R; 250/222.1, 223 R

[56] References Cited

U.S. PATENT DOCUMENTS 3,754,630 8/1973 Gilker ..... 194/4 C 3,882,982 5/1975 Smith ..... 194/4 C 3,998,309 12/1976 Mandas et al. ..... 194/97 R

*Primary Examiner*—F. J. Bartuska

[57] ABSTRACT

A system for generating a reward when a shopping cart is returned to a holding pen. The entrance to the pen is defined by a pair of spaced apart pedestals containing a light source projecting on photo diodes. When the light on the diodes is interrupted by the upright strands of a cart, a set of pulses is generated and counted. The counts are fed to decision logic which control the reward generator. The reward generator is rendered operable only if the decision logic determines that a shopping cart has been pushed between the pedestals into the holding pen.

5 Claims, 2 Drawing Figures

DEVICE FOR ENCOURAGING THE RETURN OF SHOPPING CARTS

BACKGROUND OF THE INVENTION

The present invention relates to a system for encouraging the return of shopping carts to a holding pen and in particular to a detecting circuit device for determining when a shopping cart is returned to the pen from outside the pen.

Retail stores, particularly supermarkets, are plagued by the problem of shoppers removing shopping carts from the store premises without returning them. As a result it has heretofore been proposed to offer a reward to customers for returning carts to a holding pen. See, for example, U.S. Pat. Nos. 3,165,189; 3,283,868; 3,754,630; 3,837,455; 3,882,982; 3,897,863; 3,938,638; 3,978,959, French Pat. Nos. 2,485,232 and 2,465,279 and German Pat. No. 2,900,637. With such a reward system it is important to determine if a used cart is truly being returned to the holding pen or if someone is merely removing a cart from the pen for the purpose of returning the cart to the pen so as to claim the reward.

In view of the above, it is a principle object of the present invention to provide a system utilizing a simplified circuit for detecting the return of a shopping cart to a cart holding pen.

A further object is to provide such a system which is suitable for interior and/or exterior installation.

A still further object is to provide such a system which utilizes a detecting device that is totally passive with respect to the shopping carts in that it requires no contact with the shopping carts and requires no modification to the carts.

Still another object is to provide such a system which detects attempts to trigger false rewards by determining the direction of carts past the sensing device.

Still another object is to provide such a system and detecting device which requires a minimum of supervision and maintenance by store personnel.

SUMMARY OF THE INVENTION

The above and other beneficial objects and advantages are attained in accordance with the present invention by providing a device which makes use of the fact that most shopping carts are constructed of a series of horizontal and vertical strands. There are usually 30 upright strands in each cart basket and the strands are on 1" centers. In accordance with the invention a pair of spaced pedestals define an entrance into a shopping cart holding pen. First and second light sources are mounted in one of said pedestals to project light beams onto first and second photo diodes in the other of said pedestals. As each upright strand interrupts the light beams to the photo diodes pulses are generated and subsequently counted. A cart return reward generator is controlled by decision logic which renders the reward generator operative if it determines that a shopping cart has interrupted the light beam to the photo diodes by moving into the holding pen and further determines that the light beam interruption was, in fact, caused by a shopping cart.

DESCRIPTION OF THE PREFERRED EMBODIMENT

Figure 1:
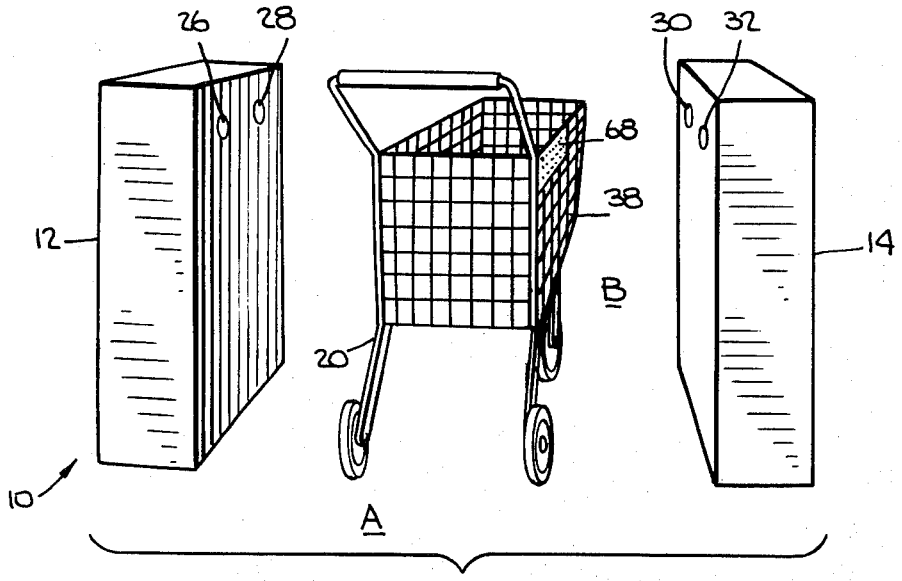
FIG. 1 is a perspective view of a system in accordance with the present invention; and, FIG. 2 is a schematic block diagram of circuitry.
Figure 2:
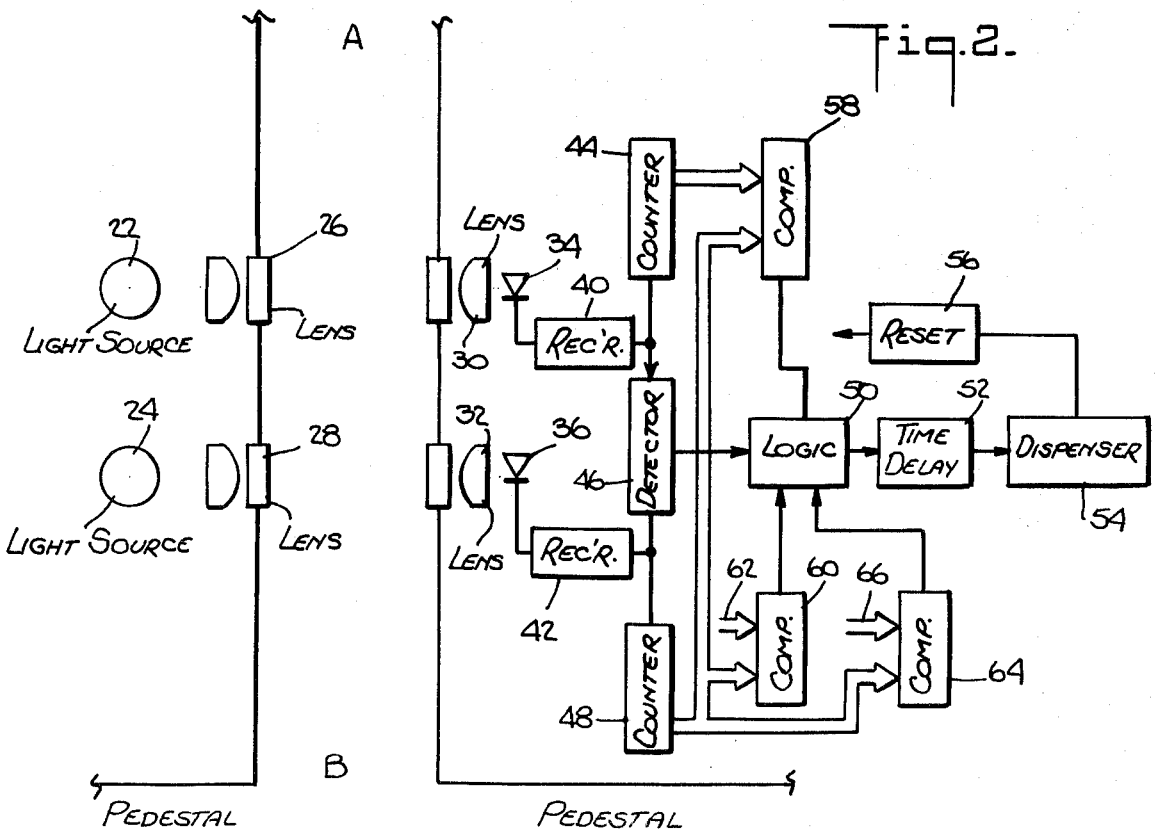

Reference is now made to the drawings and to FIG. 1 in particular wherein the shopping cart retrieval system 10 of the present invention is shown comprising a pair of spaced apart pedestals 12 and 14 at the access opening to a holding pen for shopping carts. Such pens are commonly located immediately inside or outside supermarket entrances. The pedestals are spaced approximately 26" apart to accommodate a conventional shopping cart which is approximately 24" wide.

Pedestal 12 contains a pair of spaced light sources 22, 24, spaced approximately 6 inches apart and preferably infra-red, the light rays of which are formed into conical beams by lens sets 26, 28 and respectively projected at collector lenses 30, 32 on pedestal 14. Each of the collector lenses 30, 32 directs the collected light onto a diode of a photo detector circuit 34, 36. While other shape light beams may be utilized, the conical beam is preferred since it may be focused on the strands on one side of the cart, preferably the side closest to the diodes. The lens sets 26, 28 and collector lenses 30, 32 are set at a height so that when a cart 20 passes between the pedestals the upright strands 38 of the cart interrupt the beams. The interruptions of the light beams projected onto diodes 34, 36 are detected by receivers 40, 42 respectively and converted thereby into electrical pulses. The pulses from receiver 40 are fed to a binary counter 44 and a direction detector 46. The pulses from receiver 42 are fed to direction detector 46 and a binary counter 48. The direction detector 46 operates by determining if a cart passed from A to B or from B to A by sensing whether the pulses from receiver 40 preceded or followed the pulses from receiver 42.

The output of the direction detector 46 is fed to decision logic 50, the operation and function of which will be described forthwith. The decision logic 50 output is fed to a time delay circuit 52 which, in turn, triggers a dispenser 54 unless the decision logic changes during the delay period. The dispenser 54 may, for example, provide trading stamps, discount coupons or some other form of reward to the customer returning a cart. Upon completion of the operation reset logic 56 is triggered by dispenser 54 to reset the system for the next cart to pass.

The direction detector 46 will determine if the cart passed from A to B, a "valid" pass or from B to A, an "invalid" pass. In the event of the latter, (i.e. an invalid pass) the direction detector 46 and decision logic 50 will render the system inoperable until one of two conditions are met: (1) the system detects two passes from A to B or (2) a predetermined time period has elapsed. Typically a time period of from 20 to 40 seconds may be used however any time period may be implemented.

When a valid pass is detected the pulses from receiver 40 are counted in counter 44 and the pulses from receiver 42 are counted in counter 48. The tally of counters 44 and 48 are compared in comparator 58 which feeds the results to the decision logic 50. If the tally of counter 44 exceeds that of counter 48 by a predetermined amount (determined by the nature of the receivers) the system is assumed to be sensing a cart which has been inserted into the pen and withdrawn (for purposes of collecting the reward) and rendered inoperable by decision logic 50. Another compartor 60 compares the tally of counter 48 with a preload factor 62. If the tally of counter 48 is less than the preload factor 62 (which is determined by the nature of the carts and receivers) the system is assumed to be sensing something other than a cart and rendered inoperable through decision logic 50. A comparator 64 compares the tally of counter 48 with another preload factor 66 and feeds the result to decision logic 50. If the tally of counter 48 exceeds the preload factor 66 the logic will render the system inoperable. The values of preload factors 62 and 66 may be the same and preferably are on the order of 8 to 10 for a standard cart of 30 uprights. Thus, if more than 38 or less than 22 pulses are detected (assuming both preload factors are set to permit a deviation of 8) the logic will render the system inoperable.

As noted above, three tests are applied to each cart passing through the device to determine if a reward should be generated:

1. The direction of travel of the cart is determined to be into the pen by virtue of the light to diode 30 being interrupted before the light to diode 32.
2. The presence of a cart is detected by virtue of the number of upright strands detected passing diode 32 (being within tolerances) for a cart.
3. As assurance against a cart being pushed into the device and then withdrawn, the number of stands detected by both diodes must be substantially equal (within tolerances).

As an added feature, the present device may be used to insure that only carts belonging to a particular store are being returned to the store. This may be effected by providing a plate 68 blocking some of the uprights. As a result of the plate, the number of detected uprights will be reduced and the reduced number is used to control the decision logic. As an added advantage the plate 68 may contain advertising.

Thus, in accordance with the above the aforementioned objectives are effectively attained.

Having thus described the invention what is claimed is:

1. A system for encouraging the return of shopping carts to a holding pen comprising:

a first photo diode proximal said pen; a first light source adapted to project a beam of light on said first photo diode;

a second photo diode distal said pen;

a second light source adapted to project a beam of light on said second photo diode;

the spacing between said light sources and diodes defining an entrance path into said pen;

means for generating a first set of pulses when the light beam on said first diode is interrupted;

means for generating a second set of pulses when the light beam on said second diode is interrupted;

means for providing a cart return reward;

first and second pulse counters connected respectively to said first and second pulse generating means;

a comparator connected to said first and second counters; and decision logic means connected to said comparator and said reward providing means whereby said reward providing is rendered operative only if the tally of said second counter exceeds the tally of said first counter by less than a predetermined amount.

2. The system in accordance with claim 1 wherein said shopping cart comprises a plurality of spaced upright strands and said pulse generating means are adapted to generate a pulse each time an upright strand interrupts the beam of light projected on one of said diodes.

3. The system in accordance with claims 1 or 2 further comprising a second comparator connected to the second counter and said decision logic, said second counter having a fixed value input whereby said decision logic renders said reward generating means operative only when said second counter tally exceeds said fixed value by no more than a selected amount.

4. The system in accordance with claim 1 further comprising a third comparator connected to the second counter and said decision logic, a fixed value input to said third comparator whereby said decision logic renders said reward generating means operative only when said second counter tally is less than said fixed value.

5. A system for encouraging the return of shopping carts to a holding pen comprising:

a first photo diode proximal said pen;

a first light source adapted to project a beam of light on said first photo diode;

a second photo diode distal said pen;

a second light source adapted to project a beam of light on said second photo diode;

the spacing between said light sources and diodes defining an entrance path into said pen;

first means for generating a pulse each time the light beam on said first diode is interrupted by a shopping cart strand;

second means for generating a pulse each time the light beam on said second diode is interrupted by a shopping cart strand;

means for providing a cart return reward;

first and second pulse counters connected respectively to said first and second pulse generating means, and decision logic means connected to said pulse counters and said reward providing means whereby said reward providing means is rendered operative only if the tally of said second counter exceeds the tally of said first counter by less than a predetermined amount.

* * * * *